US009214736B2

(12) United States Patent
Sarehraz et al.

(10) Patent No.: US 9,214,736 B2
(45) Date of Patent: Dec. 15, 2015

(54) SYSTEMS AND METHODS FOR MITIGATING DISTURBANCES IN A DUAL GRIDDED REFLECTOR ANTENNA

(75) Inventors: Mohammad Sarehraz, Sterling, VA (US); Huiwen Yao, Potomac, MD (US); Martin Edwards, Indianlantic, FL (US); Mark Andrew Benson, Leesburg, VA (US)

(73) Assignee: Orbital Sciences Corporation, Dulles, VA (US)

( * ) Notice: Subject to any disclaimer, the term of this patent is extended or adjusted under 35 U.S.C. 154(b) by 297 days.

(21) Appl. No.: 13/558,080

(22) Filed: Jul. 25, 2012

(65) Prior Publication Data

US 2014/0028531 A1 Jan. 30, 2014

(51) Int. Cl.

| | |
|---|---|
| ***H01Q 15/12*** | (2006.01) |
| ***H01Q 15/22*** | (2006.01) |
| ***H01Q 19/19*** | (2006.01) |
| ***H01Q 19/195*** | (2006.01) |

(52) U.S. Cl.
CPC ..... *H01Q 15/22* (2013.01); *H01Q 19/192* (2013.01); *H01Q 19/195* (2013.01)

(58) Field of Classification Search
CPC .... H01Q 15/22; H01Q 19/192; H01Q 19/195
USPC ..... 343/781 P, 779, 909, 756
See application file for complete search history.

(56) References Cited

U.S. PATENT DOCUMENTS

| | | | | |
|---|---|---|---|---|
| 4,625,214 | A * | 11/1986 | Parekh | 343/756 |
| 5,581,265 | A * | 12/1996 | Stirland et al. | 343/756 |
| 5,673,056 | A * | 9/1997 | Ramanujam et al. | 343/756 |
| 5,847,681 | A * | 12/1998 | Faherty et al. | 343/725 |
| 2004/0085254 | A1* | 5/2004 | Petersson et al. | 343/912 |
| 2006/0082512 | A1 | 4/2006 | Amyotte et al. | |

FOREIGN PATENT DOCUMENTS

| | | |
|---|---|---|
| EP | 1 643 590 | 4/2006 |
| GB | 2 182 806 | 5/1987 |
| JP | 2007 235564 | 9/2007 |
| JP | 2009 225003 | 10/2009 |
| WO | WO 02/061882 | 8/2002 |

OTHER PUBLICATIONS

International Search Report and Written Opinion in PCT Application No. PCT/US2013/051588 Nov. 20, 2013 (15 pages).

* cited by examiner

*Primary Examiner* — Hoanganh Le
(74) *Attorney, Agent, or Firm* — Ropes & Gray LLP

(57) ABSTRACT

Methods and systems for mitigating disturbances in a dual gridded reflector antenna are provided. An antenna system that includes a first reflective surface, a second reflective surface, and an intercostal ring is provided. The intercostal ring is configured to connect the first reflective surface and the second reflective surface. A baffle is disposed between the intercostal ring and a path of the electromagnetic waves. The baffle is configured to redirect the electromagnetic waves away from the intercostal ring. Alternatively, the baffle is not present, and the intercostal ring is configured to redirect a perturbed portion of an electromagnetic wave away from wave paths of electromagnetic waves reflected by the first reflective surface and the second reflective surface, respectively.

26 Claims, 10 Drawing Sheets

400

401

SYSTEMS AND METHODS FOR MITIGATING DISTURBANCES IN A DUAL GRIDDED REFLECTOR ANTENNA

BACKGROUND OF THE INVENTION

Dual Gridded Reflector (DGR) antennas are widely used in satellite communication systems. DGR antenna systems consist of two reflecting surfaces (i.e., shells), one in front of the other. The front shell is gridded, reflecting a linearly polarized electromagnetic wave, while allowing an orthogonal linearly polarized electromagnetic wave to pass through. Using this arrangement, DGR antenna systems are able to reflect two beams of electromagnetic waves having orthogonal linear polarizations. DGR systems are able to achieve low cross-polarization isolation between two orthogonally polarized beams—i.e., interference between a first beam and an orthogonally polarized second beam—and are, therefore, said to have high-cross polarization purity.

Conventional DGR antenna systems have supporting structural elements to keep the two reflective surfaces in the desired position relative to each other. These supporting structural elements would perturb the incoming and outgoing orthogonally polarized electromagnetic waves, causing deformation of the radiation patterns with additional high level of side-lobes. Such additional side-lobes are highly undesirable, especially in geographic regions where high-level isolation in the transmit and receive operating frequency bands is required.

SUMMARY

Methods and systems for mitigating disturbances in a dual gridded reflector antenna are provided.

In one embodiment of the present disclosure, an antenna system that includes a first reflective surface, a second reflective surface and an intercostal ring is provided. The intercostal ring is configured to connect the first reflective surface and the second reflective surface. A baffle is disposed between the intercostal ring and a path of an electromagnetic wave. The baffle is configured to redirect the electromagnetic waves away from the intercostal ring.

In another embodiment of the present disclosure, a method for mitigating disturbances in a dual gridded reflector antenna is provided. A baffle is configured to redirect the electromagnetic waves away from an intercostal ring. The baffle is disposed between the intercostal ring and a path of electromagnetic waves. The intercostal ring is configured to connect the first reflective surface and the second reflective surface.

In another embodiment of the present disclosure, an antenna system is provided. The antenna system includes a first reflective surface, which is configured to reflect a first portion of an electromagnetic wave having a first polarization and to allow a second portion of the electromagnetic wave having a second polarization to pass through the first reflective surface. The antenna system also includes a second reflective surface, which is configured to reflect the second portion of the electromagnetic wave having the second polarization. The antenna system also includes an intercostal ring configured to connect the first reflective surface and the second reflective surface. The intercostal ring is also configured to redirect a perturbed portion of the electromagnetic wave away from a wave path of the first portion of the electromagnetic wave reflected by the first reflective surface. The intercostal ring is also configured to redirect the perturbed portion of the electromagnetic wave away from a wave path of the second portion of the electromagnetic waves reflected by the second reflective surface.

In another embodiment of the present disclosure, a further method for mitigating disturbances in a dual gridded reflector antenna is provided. A first reflective surface is configured to reflect a first portion of an electromagnetic wave having a first polarization and to allow a second portion of the electromagnetic wave having a second polarization to pass through the first reflective surface. A second reflective surface is configured to reflect the second portion of the electromagnetic wave having the second polarization. An intercostal ring is configured to redirect a perturbed portion of the electromagnetic wave away from a wave path of the first portion of the electromagnetic wave reflected by the first reflective surface. The intercostal ring is also configured to connect the first reflective surface and the second reflective surface. The intercostal ring is also configured to redirect the perturbed portion of the electromagnetic wave away from a wave path of the second portion of the electromagnetic wave reflected by the second reflective surface.

BRIEF DESCRIPTION OF THE DRAWINGS

Further features of the invention, its nature and various advantages will be apparent upon consideration of the following detailed description, taken in conjunction with the accompanying drawings, in which like reference characters refer to like parts throughout, and in which.

DETAILED DESCRIPTION

In order to provide an overall understanding of the invention, certain illustrative embodiments will now be described.

However, it will be understood by one of ordinary skill in the art that the systems and methods described herein may be adapted and modified as is appropriate for the application being addressed and that the systems and methods described herein may be employed in other suitable applications, and that such other additions and modifications will not depart from the scope hereof.

The figures described herein show illustrative embodiments. However, the figures may not necessarily show and may not be intended to show the exact layout of the hardware components contained in the embodiments. The figures are provided to illustrate the high level conceptual layouts of the embodiments. The embodiments disclosed herein may be implemented with any suitable number of components and any suitable layout of components in accordance with principles known in the art.

As used herein, the terms 'connect' and 'connected' may describe system components that are directly or indirectly connected.

Figure 1A:
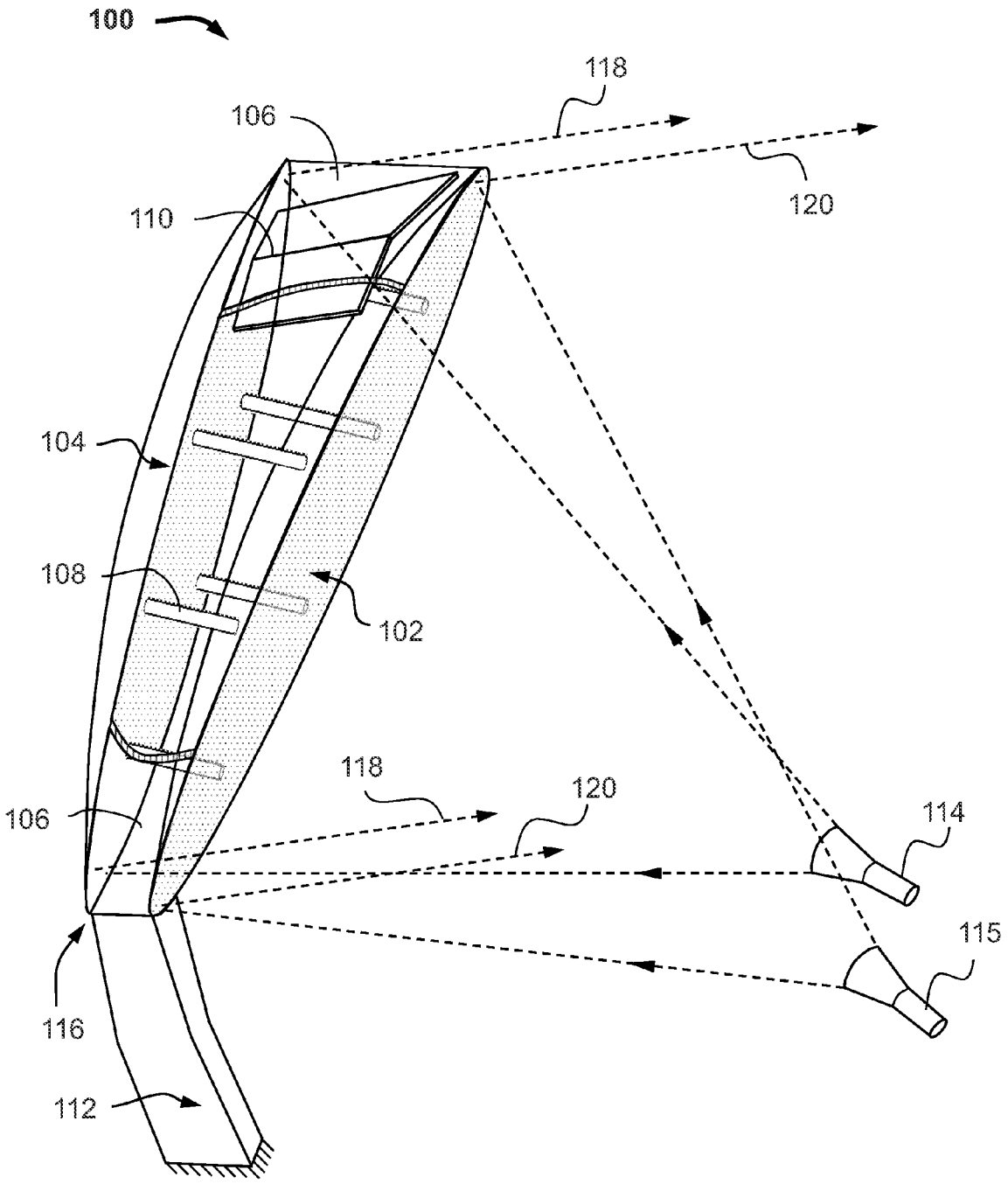
FIG. 1A shows an illustrative system for mitigating electromagnetic wave disturbances in antenna systems in accordance with an embodiment of the present disclosure.
Figure 1B:
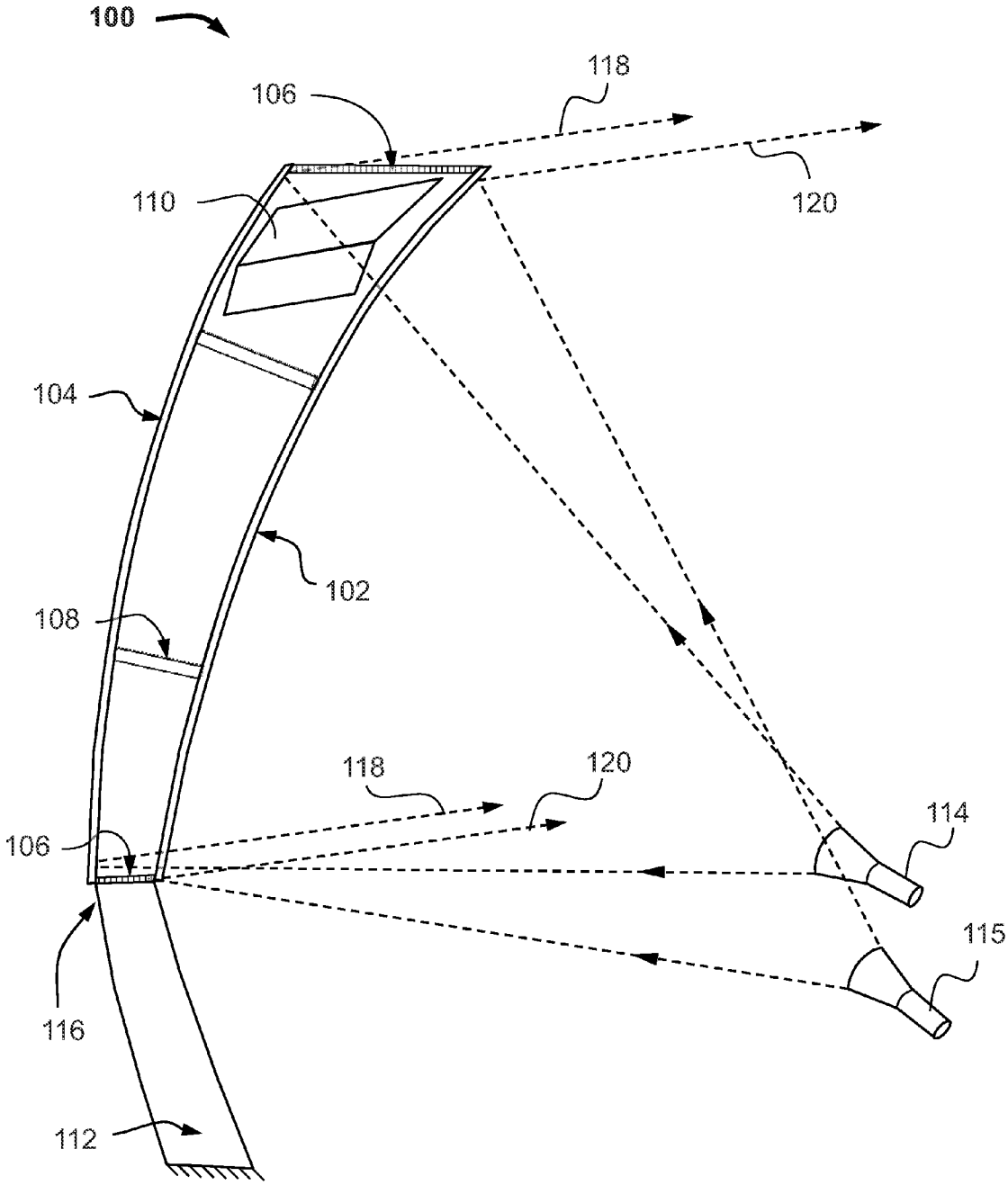
FIG. 1B shows a further illustrative system for mitigating electromagnetic wave disturbances in antenna systems in accordance with an embodiment of the present disclosure.

FIGS. 1A and 1B show profile and cross-sectional views, respectively, of an illustrative antenna system 100 for mitigating electromagnetic wave disturbances in antenna systems in accordance with an embodiment of the present disclosure. In some embodiments, antenna system 100 may be part of a larger system, such as an aerospace system or a satellite system.

Antenna system 100 includes a first reflective surface 102 (i.e., front shell 102) and a second reflective surface 104 (i.e., rear shell 104), an intercostal ring 106, one or more optional posts 108, one or more baffles 110, support structure 112, and feed horns 114 and 115. To facilitate understanding of antenna system 100, the intercostal ring 106 is depicted in FIGS. 1A and 1B in a cutaway fashion. However, it is to be appreciated by those skilled in the art that the intercostal ring 106 may extend along the entire periphery of the space between the front shell 102 and the rear shell 104. Additionally, although FIGS. 1A and 1B show two feed horns 114 and 115 for clarity of description, it will be appreciated by those skilled in the art that any number of feed horns may be used without departing from the spirit and scope of the present disclosure.

The front shell 102 of the antenna system 100 may have a concave circular shape, as shown, or may have any other suitable shape. In some embodiments, the front shell 102 is made of a dielectric material and/or a polyimide material such as KEVLAR. In some embodiments, the front shell 102 is flexible. In some embodiments, the front shell 102 is partially covered with reflective elements.

The front shell 102 is capable of polarization selectivity depending on its reflective grid alignment to the polarization of the electromagnetic waves. In particular, the front shell 102 may be transparent to certain polarizations of electromagnetic waves, while reflecting the orthogonal polarizations of electromagnetic waves. For example, the front shell 102 may reflect electromagnetic waves with vertical polarization, while being transparent to electromagnetic waves with horizontal polarization, or vice versa.

In some embodiments, the front shell 102 includes a wire grid. In these embodiments, the front shell 102 may be referred to as gridded, or as having a gridded surface. The wire grid may be composed of parallel metal wires, such as copper wires, that are spaced a certain distance apart from one another based on the operating frequency of the antenna. The wire grid may allow for polarization selectivity of the front shell. For example, a vertically aligned wire grid may allow electromagnetic waves having a polarization parallel to the wire grid (e.g., a vertical polarization) to be reflected, while passing through electromagnetic waves having a polarization that is perpendicular to the wire grid (e.g., a horizontal polarization).

The rear shell 104 of antenna system 100 may have a concave circular shape, as shown, or may have any other suitable shape. In some embodiments, the rear shell 104 is made of graphite. In some embodiments, the rear shell 104 is gridded.

In some embodiments, the rear shell 104 may reflect electromagnetic waves having any polarization. In these examples, the rear shell 104 may be referred to as lacking polarization selectivity.

The rear shell 104 is separated from the front shell 102 by a pre-determined distance. The front shell 102 and the rear shell 104 may be disposed at an angle to one another. Consequently, the separation distance between the front shell 102 and the rear shell 104 may vary between different corresponding portions of the shells. The angle at which the front shell 102 and the rear shell 104 are disposed to one another may be referred to as a clocking angle. Together, the front shell 102 and rear shell 104 may be said to form a dual reflector structure 116. When the front shell 102 is gridded, the reflector structure 116 may be referred to as a dual gridded reflector (DGR) 116.

The intercostal ring 106 connects the front shell 102 and the rear shell 104. The intercostal ring 106 may be made of any dielectric material, a material such as KEVLAR, or any other suitable material or combination of materials. The intercostal ring 106 may be substantially continuous, or may have one or more openings. The openings may be circular, or may have any other suitable shape (polygonal, curved, etc.). The intercostal ring may be circular or cylindrical, or any other suitable shape.

Antenna system 100 may include one or more optional structural elements 108 (i.e., posts 108). The posts 108 connect the front shell 102 and the rear shell 104. In some embodiments, the use of posts for connecting may aid in structurally stiffening the dual reflector structure 116. Additionally, in some embodiments the posts 108 may aid in maintaining a fixed clocking angle and/or a fixed separation distance between the front shell 102 and the rear shell 104 when the front shell 102 flexes and/or when the shape of the front shell 102 varies with temperature. The posts 108 may have any suitable shape (i.e., square, circular, polygonal, etc.), and may be made of any dielectric material, a polyimide material, such as KEVLAR, or any other suitable material.

In some embodiments, antenna system 100 includes the support structure 112. The support structure 112 may have any suitable shape, and may connect the dual reflector 116 to another system such as, e.g., a satellite. The support structure 112 may be fixed, or may allow the dual reflector 116 to be repositioned with respect to the system to which it is connected.

The feed horns 114 and 115 may be disposed at any suitable position and orientation with respect to one another, as well as any suitable position or orientation with respect to the dual reflector structure 116.

The feed horns 114 and 115 transmit and receive electromagnetic waves, such as radio frequency (RF) radiation. In some embodiments, the first feed horn 114 may operate in one polarization, and the second feed horn 115 may operate in an orthogonal polarization relative to the first feed horn polarization.

In some embodiments, the feed horns 114 and 115 and the dual reflector structure 116 may together form a dual reflector antenna. When the front shell 102 is gridded, the dual reflector antenna may be referred to as a dual gridded reflector (DGR) antenna.

Antenna system 100 may be used to transmit and receive signals (i.e., electromagnetic waves) as part of a communication scheme. For, example, a satellite using antenna system 100 may receive signals from a ground station, transmit signals to a ground station, or relay signals from one ground station to another. Any suitable communication scheme may use the antenna system 100, such as a multiple access scheme.

In embodiments where the beams from the feed horns 114 are orthogonal, antenna system 100 may be used to give coverage to different geographic regions.

Various circumstances may require certain geographic regions outside of the coverage region to have specific antenna side-lobe gain requirements. Such regions may be referred to as isolation regions, or regions requiring side-lobe isolation.

Ideally, if there are no disturbances to orthogonally polarized beams introduced by any elements of antenna system 100, the radiation patterns measured on the ground should be identical to designed radiation patterns of antenna system 100. However, in practice, elements of the antenna structure such as the posts 108 and the intercostal ring 106 may, for example, cause disturbances in antenna system 100. For example, the posts 108 and the intercostal ring 106 may perturb the electromagnetic waves reflected from the rear shell 104 and those transmitted and received by the feed horns 114 and 115. The perturbation generated by the supporting structure 106 and 108 may cause deformation of the side-lobe patterns, shapes and levels. Accordingly, the disturbed ground radiation pattern will deviate from the ideal ground radiation pattern, producing undesirable side-lobes within the disturbed ground radiation pattern. As a result, the disturbed ground radiation pattern may extend into geographic regions where isolation is required—an outcome which is highly undesirable.

In order to mitigate these antenna field disturbances, one or more baffles 110 may be used. The structure and operating principles of baffles 110 will be described in greater detail in connection with baffles 212 of FIG. 2.

Figure 2:
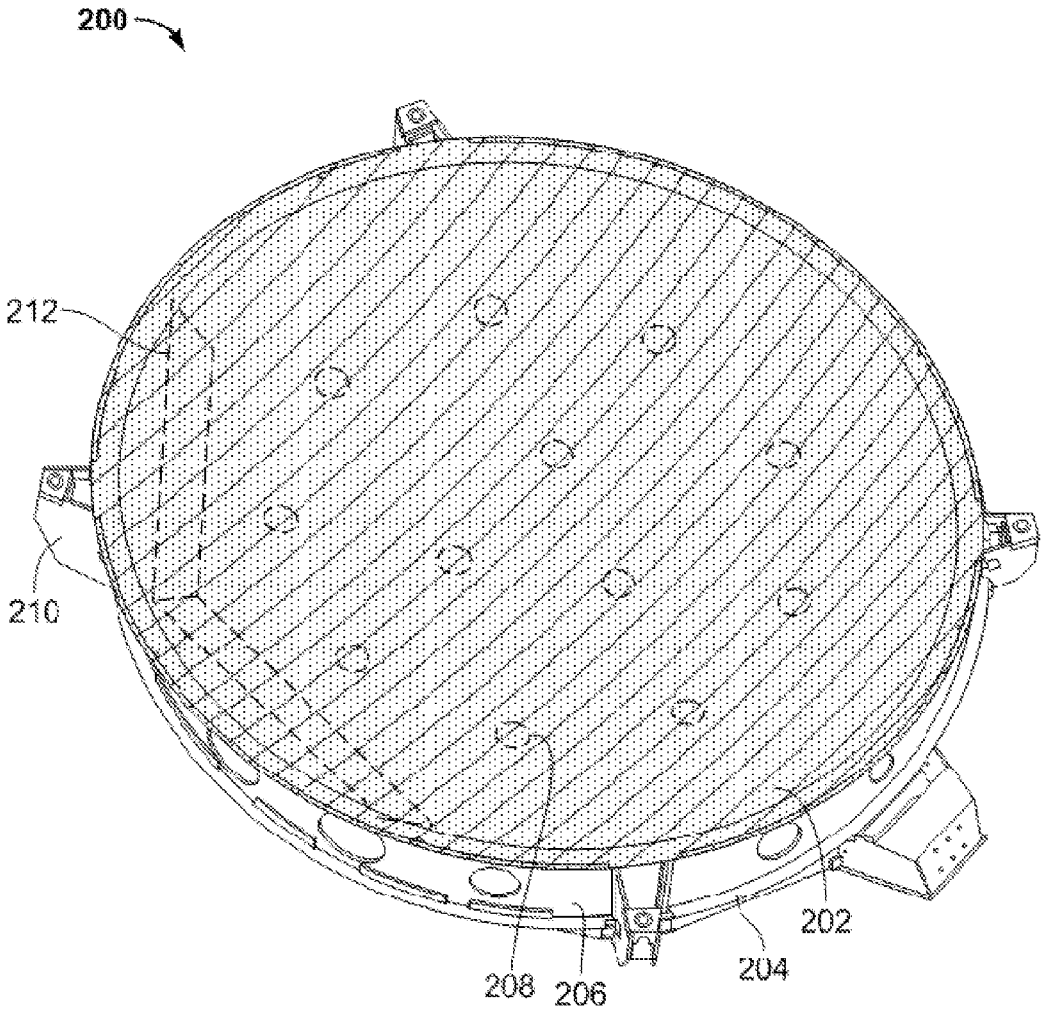
FIG. 2 shows an illustrative system for mitigating electromagnetic wave disturbances in antenna systems in accordance with an embodiment of the present disclosure.

FIG. 2 shows a further illustrative system 200 for mitigating electromagnetic wave disturbances in antenna systems in accordance with an embodiment of the present disclosure. In some embodiments, antenna system 100 may be part of a larger system, such as an aerospace system or a satellite system. In some embodiments, antenna system 200 may be a further representation of system 100 described in connection with FIGS. 1A and 1B. However, it will be appreciated by those skilled in the art that antenna system 200 may be implemented either independently from or as part of systems other than system 100 of FIGS. 1A and 1B without departing from the scope and spirit of the present disclosure.

Antenna system 200 includes a first reflector 202 (i.e., front shell 202) and a second reflector 204 (i.e., rear shell 204), an intercostal ring 206, one or more optional posts 208 (i.e., posts 208), one or more baffles 212, and an optional support structure 210. The front shell 202, the rear shell 204, the intercostal ring 206 and the posts 208 may be similar to the front shell 102, the rear shell 104, the intercostal ring 106 and the posts, respectively, described in connection with FIGS. 1A and 1B. In some embodiments, as shown in FIG. 2, the first reflector 202 may be gridded.

The baffles 212 may be disposed within the space between the front shell 202 and the rear shell 202. The baffles 212 may also be disposed within the area bounded by the intercostal ring 206. In some embodiments, the baffles 212 may be disposed between the intercostal ring 206 and the posts 208, and may, e.g., reflect electromagnetic waves reflected by the posts 208 towards the intercostal ring 206. The baffles 212 may have any suitable shape, and may be configured in any suitable arrangement, as will be described in further detail below. Additionally, the baffles may be made of any suitable material, such as a dielectric material and/or a polyimide material. The baffles 212 may be covered with a reflective material, such as copper, aluminized reflective material, or blanketing material. The baffles 212 may be rigid or flexible.

In embodiments where antenna system 202 is an embodiment of the dual reflector structure 116 of FIGS. 1A and 1B, the baffles 212 may substantially reflect electromagnetic waves to and from feed horns 114 and 115 that would otherwise impinge on and be reflected by the intercostal ring 206. The baffles 212 may be configured to steer away the higher side-lobes generated by the intercostal ring 206 and posts 208 from the regions with side-lobe isolation requirements to the region with no isolation requirements, thus better complying with isolation requirements.

The baffles 212 may have any suitable shape. For example, the baffles 212 may be composed of one or more planar regions, such as the ones shown in FIG. 2. In some embodiments, the baffles 212 may have non-planar shapes and/or curved shapes. In some embodiments, the baffles 212 may have a uniform thickness, e.g., due to being fabricated from a length of conductive and non-conductive materials. In some embodiments, the baffles 212 may have non-uniform thickness. In some embodiments, the baffles 212 may be composed of multiple sections, as shown in FIG. 2. In some embodiments, the baffles 212 may be fabricated as a single section. In some embodiments, the baffles 212 may be substantially continuous. In some embodiments, the baffles 212 may have one or more openings.

The baffles 212 may be disposed in a variety of configurations within the space between the front shell 202 and the rear shell 204. In some embodiments, the baffles 212 may be connected (i.e., attached) to the front shell 202, the rear shell 204, and/or the intercostal ring 206 by any suitable connection (i.e., attachment) means. For example, as shown in FIG. 2, the bottom edges of the baffles 212 may be connected to the rear shell 204 and the top edges of the baffles 212 may be connected to the front shell 202. In some embodiments, portions of the baffles 212 and/or corners (top and/or bottom) and/or joining points of the baffles 212 may be connected to the intercostal ring 206. In some embodiments, the baffles 212 may be directly connected to, or may be part of the intercostal ring 206.

In some embodiments, the baffles 212 may be disposed along the entire circumference of the intercostal ring 206. In some embodiments, the baffles 212 may be disposed along only a portion of the circumference of the intercostal ring 206. For example, the baffles 212 may be disposed along a portion of the intercostal ring corresponding to an area of greatest separation between the front shell 202 and the rear shell 204. Advantageously, such positioning of the baffles 212 may effectively mitigate antenna field disturbances produced by the areas of greatest separation of the intercostal ring 206, which may otherwise produce a substantial portion of the undesired electromagnetic waves. In some embodiments, the baffles 212 may be positioned such that the some portion of electromagnetic waves reflected by some baffles 212 does not impinge upon other baffles 212.

Positioning of the baffles 212 may be determined by any suitable method. In some embodiments, the positioning of the baffles 212 may be determined through a numerical electromagnetic simulation of a computer model of antenna system 200. In some embodiments, positioning of the baffles 212 may be determined based on results derived from testing conducted on a physical model of the antenna system 200 and/or baffles 212 in a radiation pattern testing range.

In some embodiments, the baffles 212 may be integrated into antenna system 200 during manufacturing and/or assembly of antenna system 200. In some embodiments, the baffles 212 may be incorporated into an antenna system that has already been assembled, via, e.g., openings in the intercostal ring 206. Advantageously, incorporation of the baffles 212 into an assembled antenna system may allow for modification of existing antenna systems (i.e., conversion of existing antenna systems into an antenna system functionally similar to antenna system 200) without disassembling these existing antenna systems.

Figure 3A:
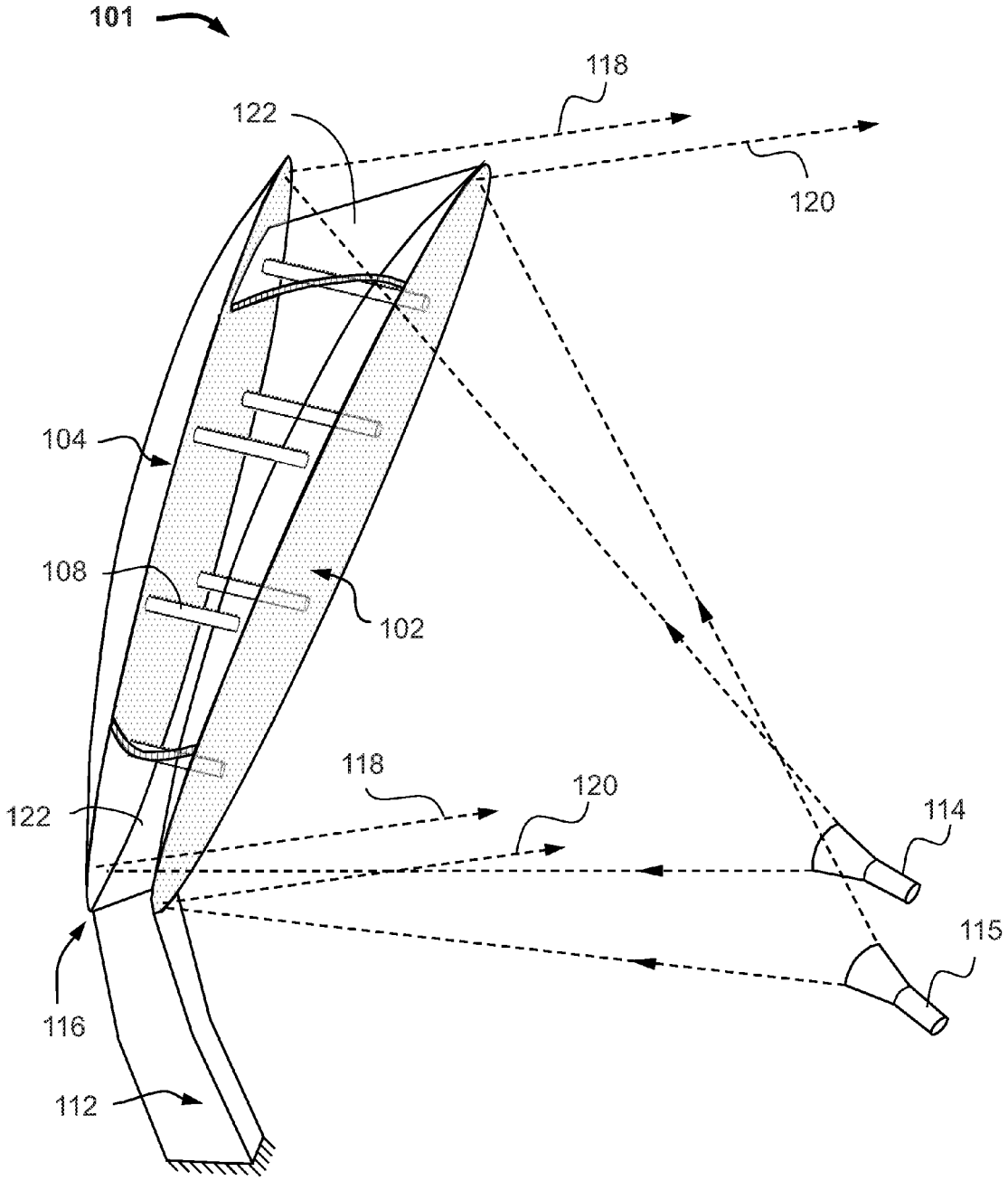
FIG. 3A shows a further illustrative system for mitigating electromagnetic wave disturbances in antenna systems in accordance with an embodiment of the present disclosure.
Figure 3B:
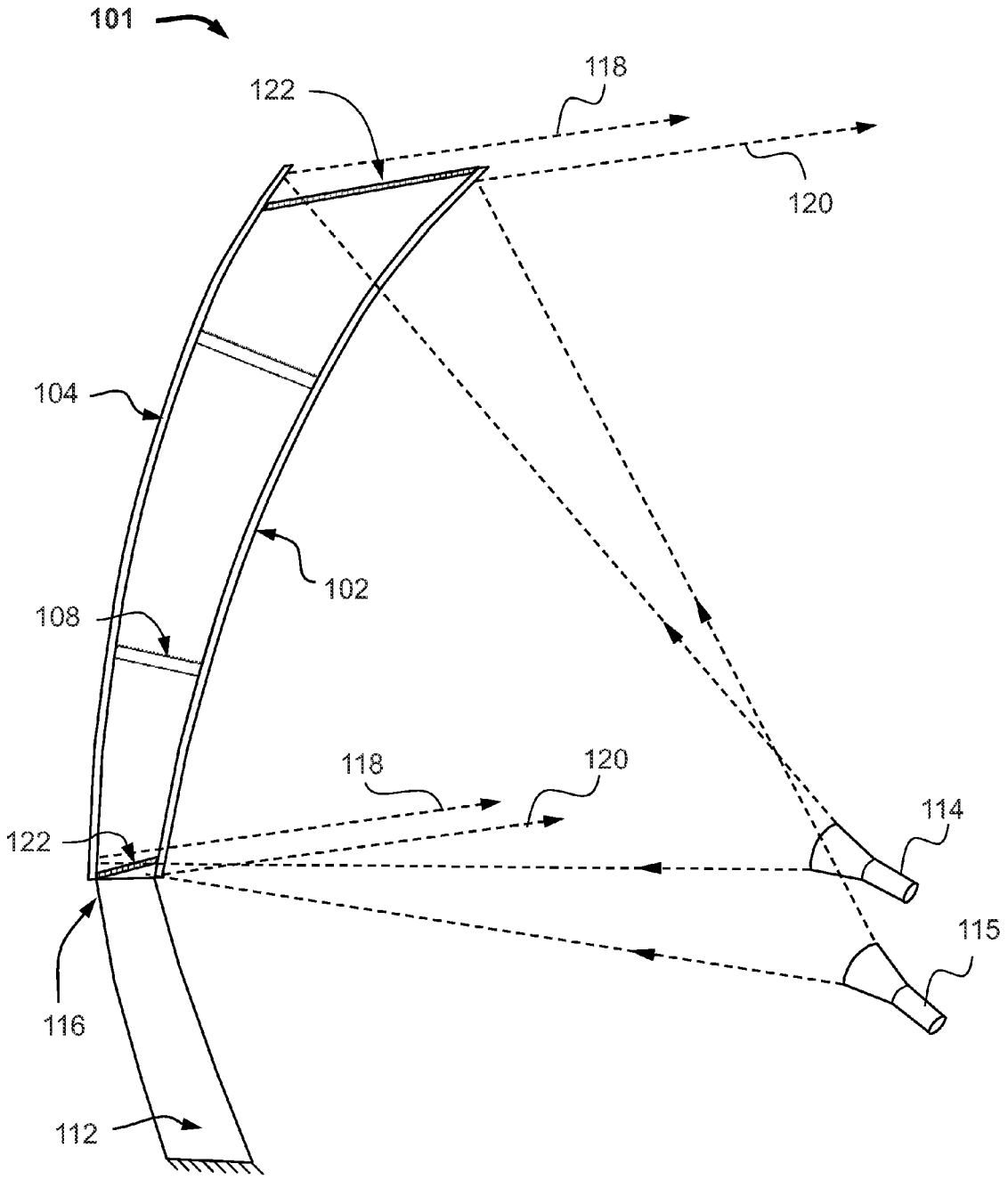
FIG. 3B shows a further illustrative system for mitigating electromagnetic wave disturbances in antenna systems in accordance with an embodiment of the present disclosure.
Figure 3C:
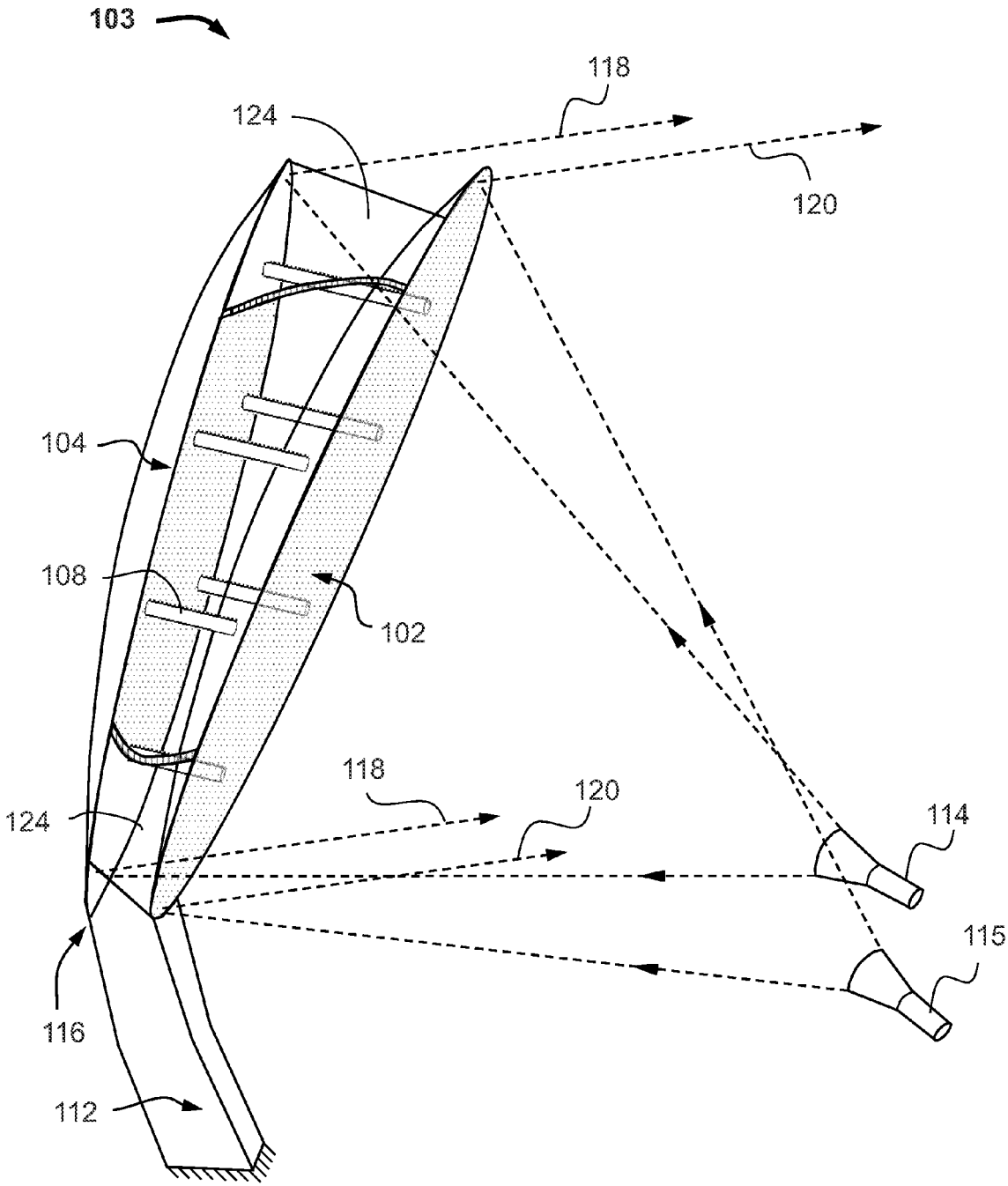
FIG. 3C shows a further illustrative system for mitigating electromagnetic wave disturbances in antenna systems in accordance with an embodiment of the present disclosure.
Figure 3D:
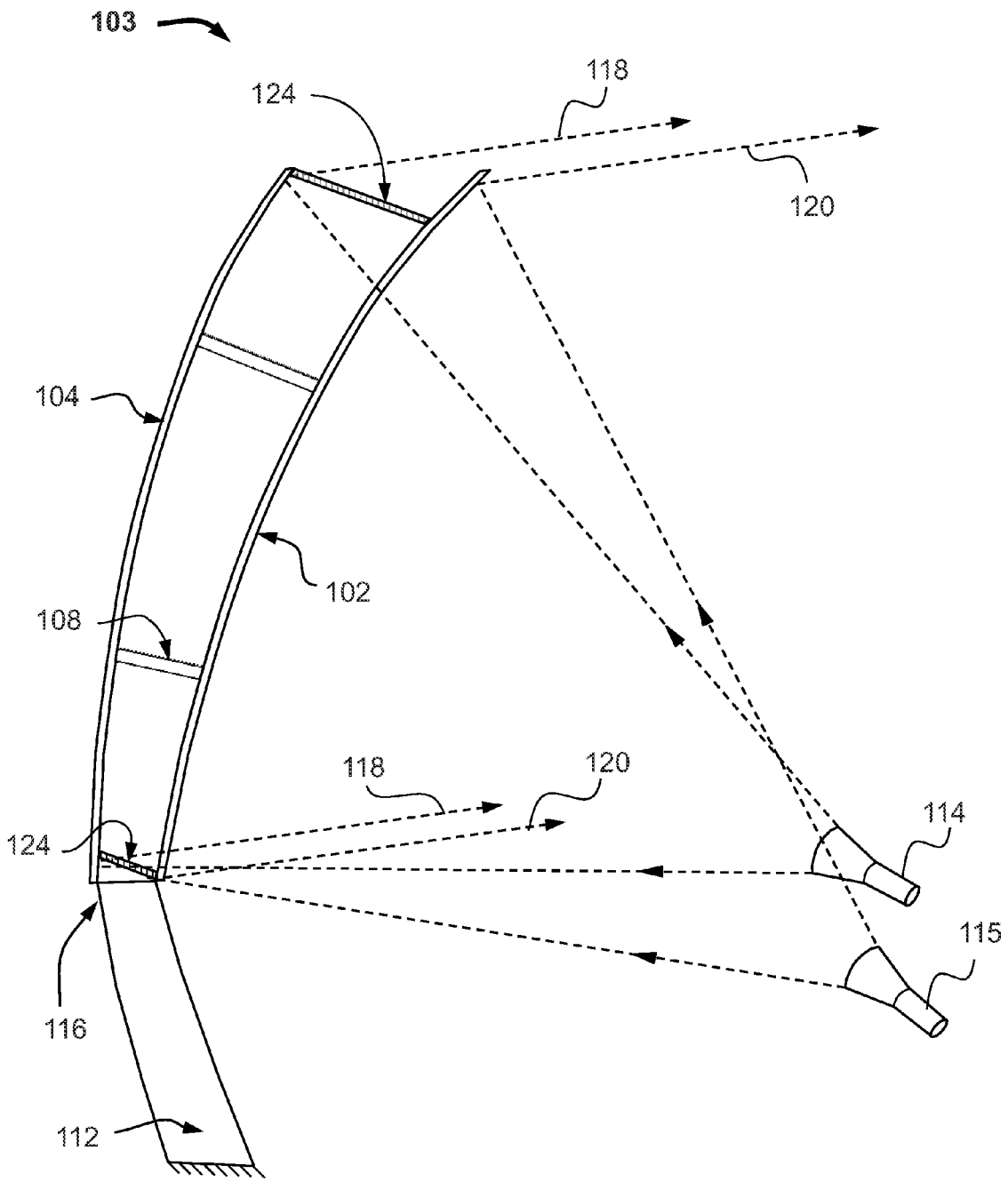
FIG. 3D shows a further illustrative system for mitigating electromagnetic wave disturbances in antenna systems in accordance with an embodiment of the present disclosure.

FIGS. 3A and 3B show profile and cross-sectional views, respectively, of an illustrative system 101 for mitigating electromagnetic wave disturbances in antenna systems in accordance with an embodiment of the present disclosure. FIGS. 3C and 3D show profile and cross-sectional views, respectively, of a further illustrative system 103 for mitigating electromagnetic wave disturbances in antenna systems in accordance with an embodiment of the present disclosure.

In systems 101 and 103, the baffles 110 of system 100 are not present, and the intercostal ring itself reconfigured to steer away side-lobes generated by that intercostal ring and posts from the regions with side-lobe isolation requirements to the region with no side-lobe isolation requirements, in order to better comply with the side-lobe isolation requirements.

The reconfigured intercostal ring may have any shape suitable for steering away the side-lobes. For example, the intercostal ring may have the shape of an oblique cylinder, i.e., a cylinder having top and bottom bases that are not aligned directly one above the other. For example, system 101 shown in FIGS. 3A and 3B has an intercostal ring 122 which takes a shape of an oblique cylinder fitted between the front shell 102 and the rear shell 104. Likewise, system 103 shown in FIGS. 3C and 3D has an intercostal ring 124 which takes a shape of an oblique cylinder fitted between the front shell 102 and the rear shell 104.

It is to be noted that the intercostal rings 122 and 124 may not have strictly cylindrical shapes, and may not have top and bottom bases that are parallel to one another. However, for ease of understanding, the intercostal rings 122 and 124 may be described as being oblique cylinders, or as being derived from oblique cylinders. Additionally, it is to be noted that the oblique cylinders may be any suitable cylinders, such as elliptical oblique cylinders. The oblique cylinders may be formed by, e.g., making parallel diagonal cuts in regular cylinders.

The top base of the intercostal ring 122 of FIGS. 3A and 3B may be shifted upward (i.e., in the direction of the respective top edges of FIGS. 3A and 3B) with respect to the bottom base of the intercostal ring 122, with the top and bottom bases of the intercostal ring 122 being those portions of the intercostal ring 122 that are in contact with the front shell 102 and rear shell 104, respectively. Accordingly, the sidewalls of the reconfigured intercostal ring 122 may be sloped upward. In some embodiments, as shown in FIGS. 3A and 3B, portions of the top and bottom bases of the intercostal ring 122 may not be coupled to the respective circumferences of the front shell 102 and rear shell 104.

The top base of the reconfigured intercostal ring 124 of FIGS. 3C and 3D may be shifted downward (i.e., in the direction of the respective bottom edges of FIGS. 3C and 3D) with respect to the bottom base of the intercostal ring 124, and the sidewalls of the intercostal ring 124 may be sloped downward). In some embodiments, as shown in FIGS. 3C and 3D, portions of the top and bottom bases of the intercostal ring 124 may not be coupled to the respective circumferences of the front shell 102 and rear shell 104.

The shapes of the intercostal rings 122 and 124 (e.g., the degree to which their respective top and bottom bases are displaced with respect to one another) may be determined through numerical electromagnetic simulations of computer models of antenna systems 101 and 103 and/or determined based on results derived from testing conducted on physical models of antenna systems 101 and 103 in a radiation pattern testing range.

Advantageously, the rings 122 and 124 may steer away side-lobes generated by the intercostal rings 122 and 124 and posts 108 from the regions with side-lobe isolation requirements to the regions with no side-lobe isolation requirements.

It will be appreciated by those skilled in the art that even though the intercostal rings 122 and 124 as described above took the shape of oblique cylinders, intercostal rings having any shape suitable for steering away the side-lobes may be used without departing from the spirit and scope of the present disclosure.

Figure 4A:
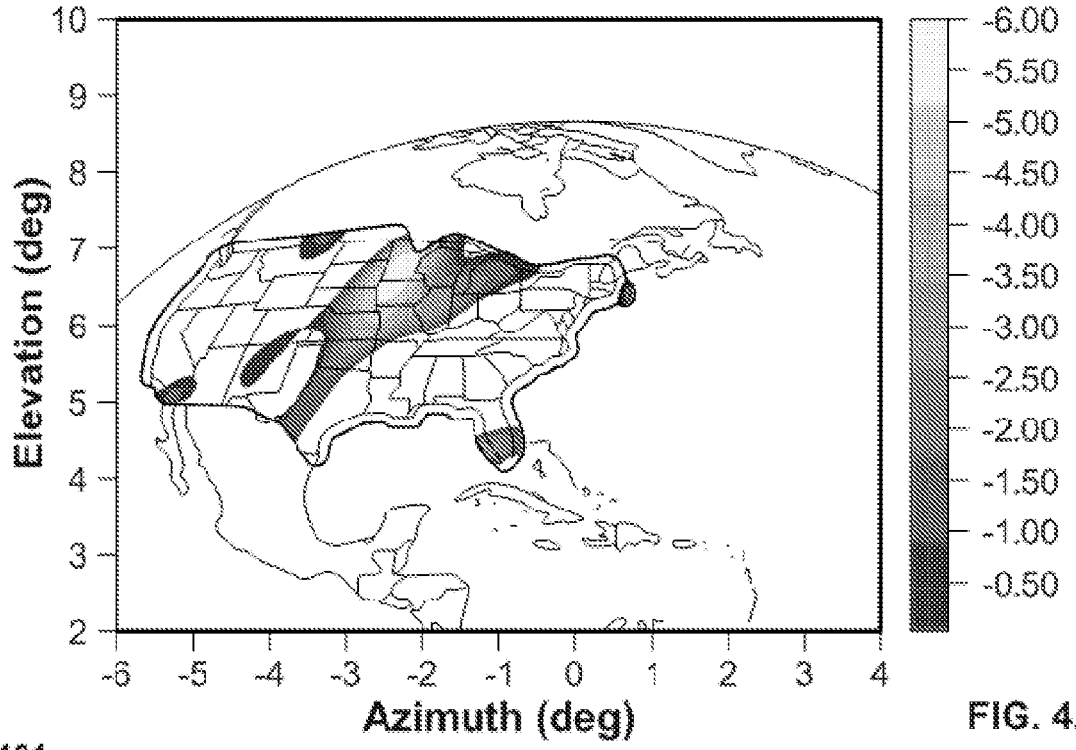
FIG. 4A shows an exemplary graphical depiction of an antenna system radiation pattern in accordance with an embodiment of the present disclosure.

FIG. 4A shows an exemplary graphical depiction 400 of an antenna system radiation pattern in accordance with an embodiment of the present disclosure.

In some embodiments, graphical depiction 400 of the ground radiation pattern corresponds to a graphical depiction of a disturbed ground radiation pattern produced by antenna systems similar to antenna systems 100 and/or 200, but lacking the baffles 110 and 212, respectively.

In graphical depiction 400, the continental United States may correspond to a region where isolation is required. Graphical depiction 400 shows side-lobe non-compliance levels—i.e., shape and position-dependent intensity of a disturbed ground radiation pattern produced within geographic regions requiring isolation by disturbed portions of electromagnetic waves transmitted by e.g., satellite antenna systems similar to those described in connection with FIGS. 1A, 1B and 2.

Figure 4B:
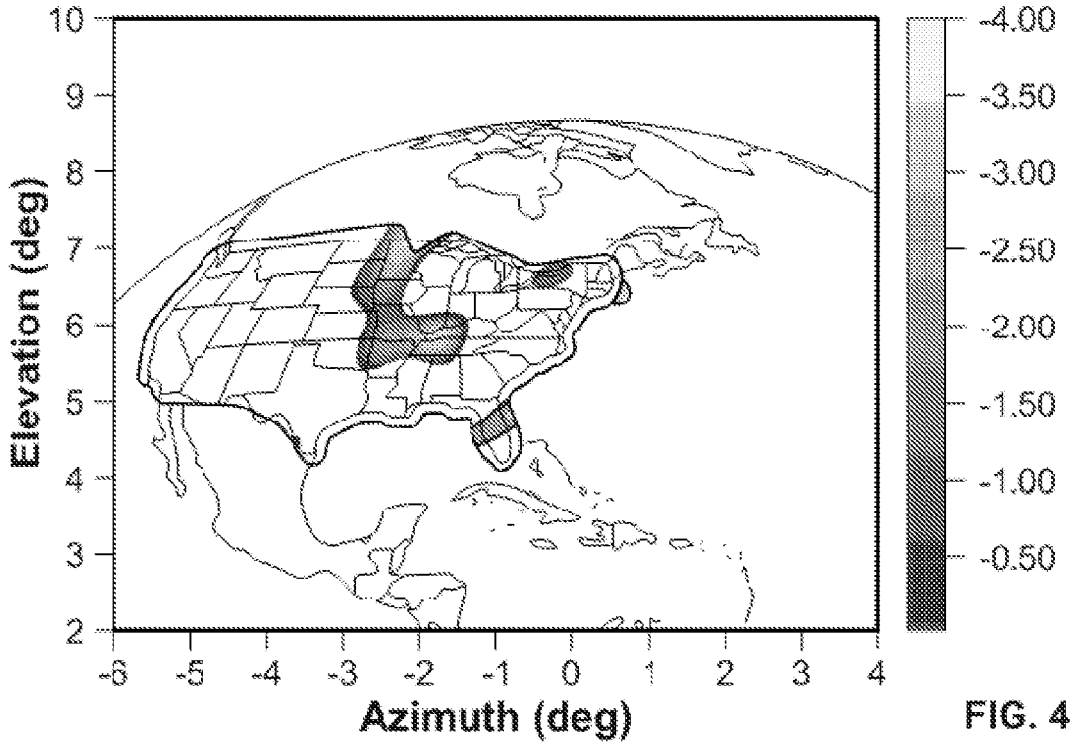
FIG. 4B shows a further exemplary graphical depiction of an antenna system radiation pattern in accordance with an embodiment of the present disclosure.

FIG. 4B shows a further exemplary graphical depiction of an antenna system radiation pattern 401 in accordance with an embodiment of the present disclosure.

In some embodiments, antenna system radiation pattern 401 corresponds to an exemplary disturbed ground radiation pattern produced by antenna systems 100 and/or 200 incorporating the baffles 110 and 212, respectively.

In graphical depiction 401, the continental United States may correspond to a region where isolation is required. Graphical depiction 401 shows an exemplary shape and position-dependent intensity of a disturbed ground radiation pattern produced by disturbed portions of electromagnetic waves transmitted by antenna systems 100 and/or 200 within the region where isolation is required (i.e., side-lobe non-compliance levels associated with antenna systems 100 and/or 200). Advantageously, the exemplary disturbed radiation pattern 401 produced by e.g., satellite antenna systems 100 and/or 200 incorporating the baffles 110 and 212 has smaller (in terms of area, peak level and total energy) non-compliant side-lobes than the exemplary disturbed radiation pattern 400 of antenna systems missing the baffles 110 and 212.

Figure 5:
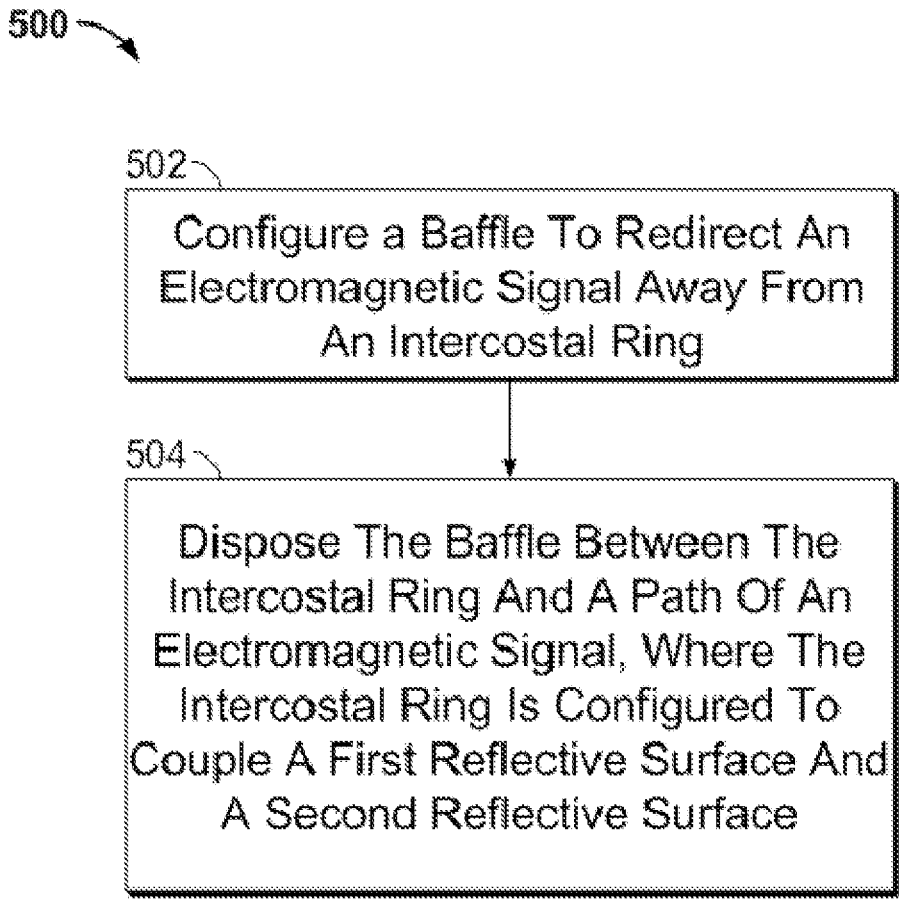
FIG. 5 shows an illustrative flow diagram of an exemplary process for mitigating electromagnetic wave disturbances in antenna systems according to an embodiment of the present disclosure.

FIG. 5 shows an illustrative flow diagram of an exemplary process 500 for mitigating electromagnetic wave disturbances in antenna systems according to an embodiment of the present disclosure. In some embodiments, process 500 may be performed using system 100 of FIGS. 1A and 1B, system 201 of FIG. 2, and/or a combination thereof. However, it will appreciated by those skilled in the art that process 500 may be performed either independently from or as part of systems other than antenna system 100, antenna system 200, and/or the combination thereof, without departing from the scope and spirit of the present disclosure.

At 502, a baffle is configured to redirect an electromagnetic wave away from an intercostal ring;

At 504, the baffle is disposed between the intercostal ring and a path of an electromagnetic wave. The intercostal ring is configured to connect a first reflective surface and a second reflective surface.

Figure 6:
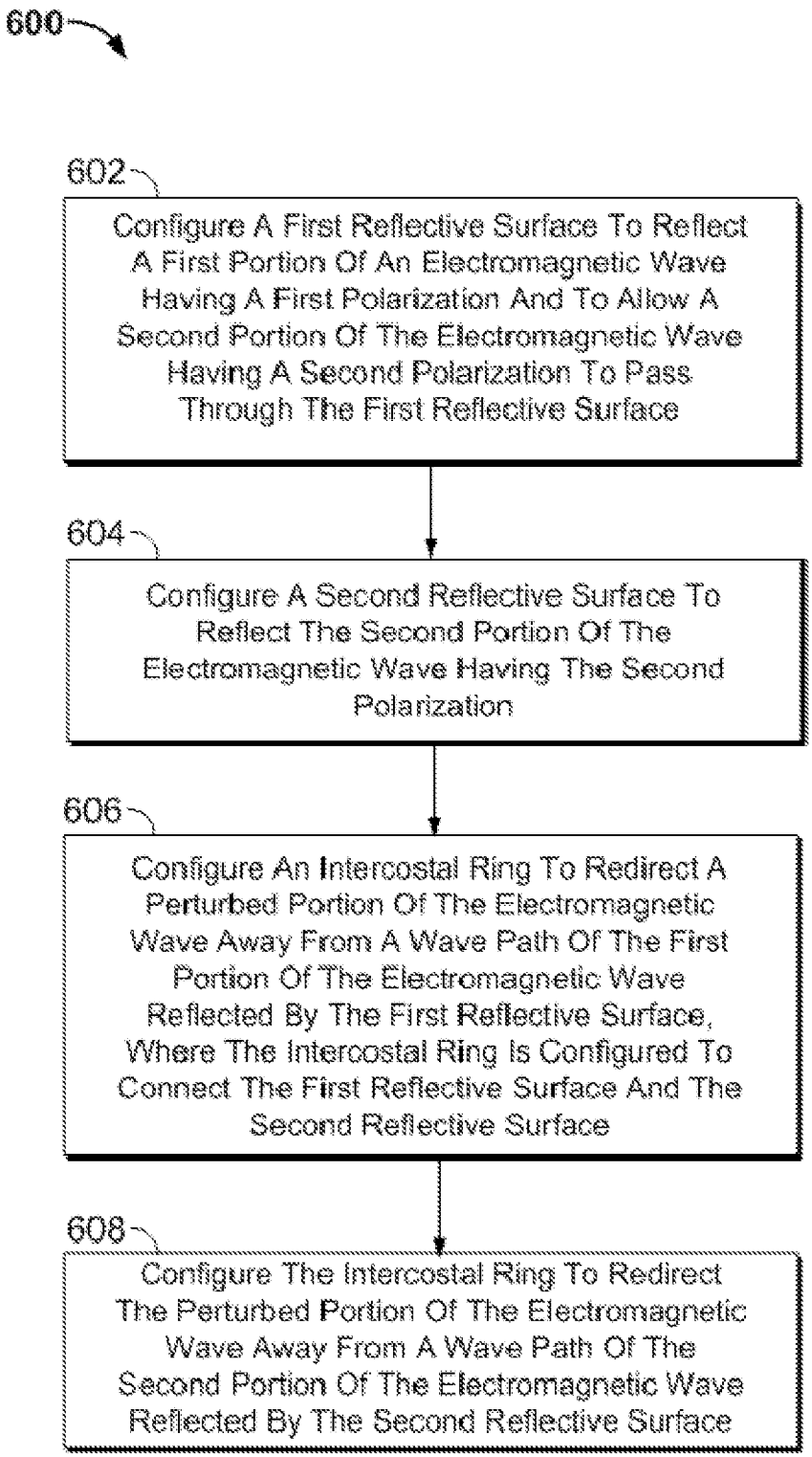
FIG. 6 shows an illustrative flow diagram of a further exemplary process for mitigating electromagnetic wave disturbances in antenna systems according to an embodiment of the present disclosure.

FIG. 6 shows an illustrative flow diagram of an exemplary process 600 for mitigating electromagnetic wave disturbances in antenna systems according to an embodiment of the present disclosure. In some embodiments, process 600 may be performed using antenna system 101 of FIGS. 3A and 3B, antenna system 103 of FIGS. 3C and 3D, and/or a combination thereof. However, it will appreciated by those skilled in the art that process 600 may be performed either independently from or as part of systems other than antenna system 101, antenna system 103, and/or the combination thereof, without departing from the scope and spirit of the present disclosure.

At 602, a first reflective surface is configured to reflect a first portion of an electromagnetic wave having a first polarization and to allow a second portion of the electromagnetic wave having a second polarization to pass through the first reflective surface.

At 604, a second reflective surface is configured to reflect the second portion of the electromagnetic wave having the second polarization.

At 606, an intercostal ring is configured to redirect a perturbed portion of the electromagnetic wave away from a wave path of the first portion of the electromagnetic wave reflected by the first reflective surface, where the intercostal ring is further configured to connect the first reflective surface and the second reflective surface.

At 608, the intercostal ring is further configured to redirect the perturbed portion of the electromagnetic wave away from a wave path of the second portion of the electromagnetic wave reflected by the second reflective surface.

The foregoing is merely illustrative of the principles of the embodiments. Various modifications can be made by those skilled in the art without departing from the scope and spirit of the embodiments disclosed herein. The above described embodiments of the present disclosure are presented for purposes of illustration and not of limitation, and the present invention is limited only by the claims which follow.

What is claimed is:

1. An antenna system comprising:

a first reflective surface;

a second reflective surface;

an intercostal ring configured to connect the first reflective surface and the second reflective surface; and a baffle disposed between the intercostal ring and a source of an electromagnetic wave, wherein the baffle is configured to redirect the electromagnetic wave away from the intercostal ring, and wherein the baffle contacts the first reflective surface.

2. The system of claim 1, further comprising one or more posts configured to connect the first surface to the second surface, wherein the baffle is disposed between the intercostal ring and one or more posts.

3. The system of claim 1, wherein:

the first reflective surface is configured to reflect a first portion of the electromagnetic wave having a first polarization and to allow a second portion of the electromagnetic wave having a second polarization to pass through the first reflective surface, and the second reflective surface is configured to reflect the second portion of the electromagnetic wave having the second polarization.

4. The system of claim 3, wherein the first polarization is orthogonal to the second polarization.

5. The system of claim 3, wherein:

the first portion of the electromagnetic wave is transmitted or received by a first feed horn element, and the second portion of the electromagnetic wave is transmitted and received by a second feed horn element.

6. The system of claim 3, wherein:

the baffle is configured to redirect a perturbed portion of the electromagnetic wave away from a wave path of the first portion of the electromagnetic wave reflected by the first reflective surface, and the baffle is configured to redirect the perturbed portion of the electromagnetic wave away from a wave path of the second portion of the electromagnetic wave reflected by the second reflective surface.

7. The system of claim 1, wherein the first surface is disposed between the second surface and a source of the electromagnetic wave.

8. The system of claim 1, wherein the baffle is connected to one or more of the first reflective surface, the second reflective surface, and the intercostal ring.

9. The system of claim 1, wherein the first reflector, second reflector, and the intercostal ring are assembled into a dual-gridded reflector system, and wherein the baffle is inserted into the assembled dual-gridded reflector system without disassembling the assembled dual-gridded reflector system.

10. The system of claim 1, wherein the baffle is disposed between the source of the electromagnetic wave and a portion of the intercostal ring corresponding to a largest separation between corresponding connected portions of the first reflective surface and the second reflective surface.

11. The antenna system of claim 1, wherein the baffle further contacts the second reflective surface.

12. A method comprising:

configuring a baffle to redirect an electromagnetic wave away from an intercostal ring; and disposing the baffle between the intercostal ring and a source of an electromagnetic wave, wherein:

the intercostal ring is configured to connect a first reflective surface and a second reflective surface; and the baffle contacts the first reflective surface.

13. The method of claim 12, wherein:

one or more posts are configured to connect the first reflective surface to the second reflective surface, and the baffle is disposed between the intercostal ring and the one or more posts.

14. The method of claim 12, wherein:

the first reflective surface is configured to reflect a first portion of the electromagnetic wave having a first polarization and allow a second portion of the electromagnetic wave having a second polarization to pass through the first reflective surface, and the second reflective surface is configured to reflect the second portion of the electromagnetic wave having the second polarization.

15. The method of claim 14, wherein the first polarization is orthogonal to the second polarization.

16. The method of claim 14, wherein:

the first portion of the electromagnetic wave is transmitted and received by a first feed horn element, and the second portion of the electromagnetic wave is transmitted and received by a second feed horn element.

17. The method of claim 14, wherein:

the baffle is configured to redirect a perturbed portion of the electromagnetic wave away from a wave path of the first portion of the electromagnetic wave reflected by the first reflective surface, and the baffle is configured to redirect the perturbed portion of the electromagnetic wave away from a wave path of the second portion of the electromagnetic wave reflected by the second reflective surface.

18. The method of claim 12, wherein the first surface is disposed between the second surface and a source of the electromagnetic wave.

19. The method of claim 12, wherein the baffle is connected to one or more of the first reflective surface, the second reflective surface, and the intercostal ring.

20. The method of claim 12, wherein the first reflector, second reflector, and the intercostal ring are assembled into a dual-gridded reflector system, the method further comprising:

inserting the baffle into the assembled dual-gridded reflector system without disassembling the assembled dual-gridded reflector system.

21. The method of claim 12, further comprising:

disposing the baffle between the source of the electromagnetic wave and a portion of the intercostal ring corresponding to a largest separation between corresponding connected portions of the first reflective surface and the second reflective surface.

22. The method of claim 12, wherein the baffle further contacts the second reflective surface.

23. An antenna system comprising:

a first reflective surface configured to reflect a first portion of an electromagnetic wave having a first polarization and to allow a second portion of the electromagnetic wave having a second polarization to pass through the first reflective surface;

a second reflective surface configured to reflect the second portion of the electromagnetic wave having the second polarization; and an intercostal ring configured to connect the first reflective surface and the second reflective surface wherein:

the intercostal ring is configured to redirect a perturbed portion of the electromagnetic wave away from a wave path of the first portion of the electromagnetic waves reflected by the first reflective surface, the intercostal ring is configured to redirect the perturbed portion of the electromagnetic wave away from a wave path of the second portion of the electromagnetic wave reflected by the second reflective surface, the intercostal ring connects a periphery of the first reflective surface to an interior of the second reflective surface, and the intercostal ring connects a periphery of the second reflective surface to an interior of the first reflective surface.

24. The antenna system of claim 23, wherein the intercostal ring is an oblique cylinder.

25. A method comprising:

configuring a first reflective surface to reflect a first portion of an electromagnetic wave having a first polarization and to allow a second portion of the electromagnetic wave having a second polarization to pass through the first reflective surface;

configuring a second reflective surface to reflect the second portion of the electromagnetic wave having the second polarization;

configuring an intercostal ring to redirect a perturbed portion of the electromagnetic wave away from a wave path of the first portion of the electromagnetic wave reflected by the first reflective surface, wherein the intercostal ring is configured to connect the first reflective surface and the second reflective surface, configuring the intercostal ring to redirect the perturbed portion of the electromagnetic wave away from a wave path of the second portion of the electromagnetic wave reflected by the second reflective surface, configuring the intercostal ring to connect a periphery of the first reflective surface to an interior of the second reflective surface, and configuring the intercostal ring to connect a periphery of the second reflective surface to an interior of the first reflective surface.

26. The method of claim 25, wherein the intercostal ring is an oblique cylinder.

* * * * *